US005145558A

United States Patent [19]

Christiansen et al.

[11] Patent Number: 5,145,558

[45] Date of Patent: Sep. 8, 1992

[54] COMPOSITION FOR ALKALINE PEROXIDE BLEACHING OF WOOD PULP USING A QUATERNARY AMINE AS ADDITIVE

[75] Inventors: Steven H. Christiansen, Richwood; Teresa Littleton; Robert T. Patton, both of Lake Jackson, all of Tex.

[73] Assignee: The Dow Chemical Company, Midland, Mich.

[21] Appl. No.: 656,398

[22] Filed: Feb. 15, 1991

Related U.S. Application Data

[63] Continuation-in-part of Ser. No. 437,482, Nov. 15, 1989, Pat. No. 5,013,404.

[51] Int. Cl.[5] ..... D21C 9/12; D21C 9/14

[52] U.S. Cl. ..... 162/72; 162/74; 162/76; 162/78; 162/80; 8/111; 252/186.29

[58] Field of Search ..... 162/72, 74, 76, 78, 162/80, 87; 8/111; 252/186.29

[56] References Cited

U.S. PATENT DOCUMENTS

| | | | |
|---|---|---|---|
| 3,860,391 | 1/1975 | King et al. . | |
| 3,996,151 | 12/1976 | Kirner | 8/111 |
| 4,238,282 | 12/1980 | Hyde . | |
| 4,239,643 | 12/1980 | Kowalski . | |
| 4,614,646 | 9/1986 | Christiansen . | |
| 4,732,650 | 3/1988 | Michalowski et al. . | |

FOREIGN PATENT DOCUMENTS 1425307 2/1976 United Kingdom .

OTHER PUBLICATIONS

William G. Strunk, *Pulp & Paper*, "Factors Affecting Hydrogen Peroxide Bleaching for High-brightness TMP" by William G. Strunk, Jun. 1980, pp. 156–161.

'Hydrogen Peroxide Bleaching of Draft Pulp and the Role of Stabilization of Hydrogen Peroxide' by G. Papageorges, et al; given at ESPRA Meeting in Maastrict, Netherlands; May 1979.

G. W. Kutney, *Pulp & Paper*, "Hydrogen Peroxide: Stabilization of Bleaching Liquors", 1985, pp. T402–T409.

*Primary Examiner*—Steve Alvo

[57] ABSTRACT

A composition for alkaline hydrogen peroxide bleaching of mechanical wood pulp which employs a quaternary amine compound, such as (3-chloro-2-hydroxypropyl) trimethyl ammonium chloride, in the stabilized bleach solution. The brightness of the final paper product made from such bleached pulp shows marked improvement over that in which only chelating agents are employed to improve the brightness according to the known art. The process is useful in both silicate and silicate-free bleach solutions.

25 Claims, No Drawings

COMPOSITION FOR ALKALINE PEROXIDE BLEACHING OF WOOD PULP USING A QUATERNARY AMINE AS ADDITIVE

CROSS REFERENCE TO THE RELATED APPLICATION

This application is a continuation-in-part of application Ser. No. 07/437,482 filed Nov. 15, 1989, now U.S. Pat. No. 5,013,404.

BACKGROUND OF THE INVENTION

Cellulosic materials, including wood pulp for paper making and cotton fibers in the manufacture of textiles, require bleaching. One method of bleaching wood pulp employs an alkaline system using hydrogen peroxide. The factors affecting such processes are described in *Pulp & Paper,* June 1980, pp. 156–161. Alkalinity is one factor, e.g. high pH favors the bleaching process, but also accelerates the decomposition of the peroxide which wastes the bleaching agent. The control of metal ions to prevent their interaction with the peroxide is another factor. This is accomplished by the addition of chelating agents. Temperature, pulp density and type of wood are other factors which affect the brightness in the process of bleaching thermal mechanical pulp with hydrogen peroxide.

In the process of making wood pulp, metal ions can enter the system from several sources including the wood itself, the water and the machinery used to masticate the wood chips and pulp. While some of the metal ion content is lost in the deckering or dewatering step, it is sometimes an advantage to add a chelating agent. Of all the commercially available chelating agents, the one reported to be the most effective is the sodium salt of diethylenetriaminepentaacetic acid (DTPA). This is found in an article titled "The Effect of DTPA on Reducing Peroxide Decomposition", D. R. Bambrick, TAPPI Journal, June 1985, pp. 96–100. Silicates are commonly used as peroxide stabilizers in the bleach liquor. The use of silicates in such systems, however, results in insoluble silicates being deposited upon the machinery employed as well as the pulp fibers. When deposited on the pulp fibers the result is a harsher feel of the paper while the fouling of equipment can cause down-time and a shorter life for the equipment. Because of this, silicate-free systems have been suggested as an alternative.

These silicate-free systems have been found to work well in the single stage hydrogen peroxide bleaching of Kraft pulps where the choice of stabilizer possibly influences the bleaching mechanism by changing the reaction pathway of hydrogen peroxide. In such systems, the addition of poly(α-hydroxyacrylate) as a stabilizer also has been shown to improve pulp brightness. British patent 1,425,307 discloses a method for preparing this stabilizer. The use of this stabilizer is discussed in a paper "Hydrogen Peroxide Bleaching of Kraft Pulp and the Role of Stabilization of Hydrogen Peroxide", by G. Papageorges, et. al., given at the ESPRA Meeting in Maastricht, Netherlands, May, 1979.

In U.S. Pat. No. 3,860,391 the bleaching of cellulose fibers and mixtures thereof with synthetic fibers is accomplished by employing peroxide in a silicate-free system in the presence of an aliphatic hydroxy compound, an aminoalkylenephosphonic acid compound and, alternatively, with the addition of a polyaminocarboxylic acid. Representative of the above are erythritol or pentaerythritol, ethylenediaminetetra(methylenephosphonic acid) or 1-hydroxpropane-1,1,3-triphosphonic acid and ethylenediaminetetraacetic acid or nitrilotriacetic acid, respectively.

U.S. Pat. No. 4,238,282 describes a pulp bleaching system employing chlorine (not peroxide) which uses various chelating agents, including acrylic acid polymers of <2000 mol. wt., alkylene polyaminocarboxylic acids and aminophosphonic acids and their salts.

Another patent (U.S. Pat. No. 4,239,643) and its divisional (U.S. Pat. No. 4,294,575) employ phosphonic acids, such as indicated above, in a peroxide bleaching system. The above two patents include as the stabilizer for the peroxide a combination of an alkali metal polyphosphate and an alkali metal diethylenetriaminepenta(methylenephosphonic acid). The weight ratio of polyphosphate to phosphonic acid used varies from 10:1 to 1:5.

While, as noted above, various combinations of chelating agents are useful in stabilizing peroxide bleaching systems, the presence of metal ions, e.g. iron, manganese and copper, provides a catalytic effect with respect to the decomposition of the peroxide and also tends to reduce the brightness of finished mechanical pulps. While the chelants might be expected to take care of minor amounts of the metal ions, the presence of significant amounts of magnesium and/or calcium ions which may be present in the wood pulp or water or both tends to overwhelm the ability of the chelants to complex the iron, manganese and copper ions.

In a tower bleaching process chelating agents (chelants) such as aminocarboxylic acids, e.g. DTPA, are added prior to the deckering (dewatering) step. A large percentage of the metal ions, therefore, are removed as metal chelates in the deckering process. Additional chelants can also be added in the bleaching step as shown in U.S. Pat. No. 4,732,650 wherein the pulp is treated with a polyaminocarboxylic acid and, after a dewatering step, bleached with a stabilized alkaline peroxide aqueous solution (U.S. Pat. No. 4,614,646) containing a combination of an aminophosphonic acid chelant together with a polycarboxylic acid, a polycarboxylic amide or a sulfonic acid derivative of a polyamide.

In contrast to the tower process defined above, however, the pulp is not dewatered prior to the bleaching step in a typical refiner bleaching process Thus, chelants can be added prior to and/or with the bleach solution to control the effect of transition metals in the pulp slurry of the refiner process.

SUMMARY OF THE INVENTION

Quaternary amine compounds, e.g. (3-chloro-2-hydroxypropyl)trimethyl ammonium chloride, improve the brightness of the final paper product when added to the bleach solution employed in an alkaline peroxide bleach process for mechanical wood pulp. Quaternary amines are effective in the peroxide bleaching process regardless of the stabilizer employed. Thus, aminocarboxylic acids, aminophosphonic acids and silicates and various combinations of these stabilizers can be employed with the quaternary compounds of the invention. The brightness of the paper product made is improved over that of paper made by the peroxide bleaching process conducted without using the quaternary amine additive.

The invention also includes compositions including the quaternary amines with other compounds present in the bleaching process.

In one aspect the present invention is a composition for bleaching wood pulp comprising water, hydrogen peroxide, at least one stabilizer for the hydrogen peroxide and at least one quaternary amine represented by Formula I or Formula 2 wherein Formula I is:

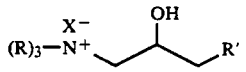

wherein

R is an alkyl group containing 1-3 carbon atoms and R' is hydrogen, a halogen, hydroxyl, R or $-N^+(R)_3$, together with $X^-$, and $X^-$ is a negatively charged counter-ion;

and Formula 2 is:

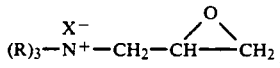

wherein

R is an alkyl group containing 1-3 carbon atoms and $X^-$ is a negatively charged counter-ion.

DETAILED DESCRIPTION OF THE INVENTION

According to the process of the present invention, a quaternary amine or salt thereof is added to the peroxide bleach solution. The hydrogen peroxide bleach may be stabilized in any manner known to the art, i.e. with soluble silicates, aminocarboxylic acids, polyphosphates, aminophosphonic acids or combinations thereof. Soluble forms include salts, preferably alkali metal salts.

The quaternary amines of the invention are represented by the structural formula:

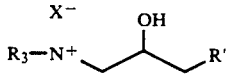

wherein R is an alkyl group containing 1-3 carbon atoms and R' is hydrogen, a halogen, hydroxyl, R or $-N^+R_3$ (together with $X^-$) and $X^-$ is a negatively charged counter-ion. If R' is halogen, an epoxy group may be formed by the elimination of hydrogen halide by reaction of the hydroxyl and halogen substituents on adjacent carbon atoms under basic pH conditions. Such epoxy compounds can be formed in situ in the presence of the alkaline solution of bleach or the epoxy derivative of the halohydrin can be used in its place as the additive.

The quaternary amines exemplified in the following experiments have the structures:

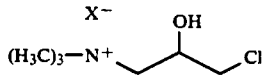

Quat 188

-continued

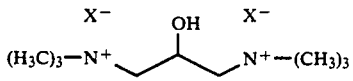

DiQuat

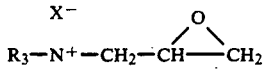

Thus, examples include (3-chloro-2-hydroxy propyl) trimethyl ammonium chloride: bis(trimethylammonium chloride)-2-hydroxy propane, as well as (2,3-epoxypropyl)trimethyl ammonium chloride and (2,3-dihydroxy propyl)trimethyl ammonium chloride.

The invention is illustrated by the following description of the process conducted in the laboratory which simulates the alkaline peroxide bleaching of mechanical wood pulp in a refiner process.

Experimental Procedure

Wood pulp is (1) pretreated with diethylenetriaminepentaacetic acid in an aqueous bath and heated to a temperature of cc.100° C. and digested for 15-20 minutes and (2) an aqueous solution containing NaOH, a quaternary amine compound and a stabilizer* are added to the pulp followed by aqueous $H_2O_2$. The same temperature used in the pretreatment is used throughout the bleaching period of 20-25 minutes. After the bleaching step, $H_2SO_4$ is added to the pulp to reduce the pH to about 4.5.

* The stabilizer is an aqueous solution containing about 30% wt. % diethylenetriaminepenta(methylenephosphonic acid) and about 10 wt. % sodium salt of polyacrylic acid.

The bleach liquor is made to contain 2.04% $H_2O_2$ and 0.2% of the stabilizer based on the oven dry weight (ODW) of the wood pulp. The alkalinity is adjusted to the same level for each Experiment by varying the amount of aqueous NaOH added. Quat 188 was used in Examples 1a, 1b and 1c while DiQuat* was used in Examples 2a and 2b. The amounts of quaternary amines used in the Experiments are shown in the Table.

** Quat 188 used in the above experiment is a commercially available product of The Dow Chemical Company which is an aqueous solution of 60-69 wt % of (3-chloro-2-hydroxy-propyl)trimethylammonium chloride.

*** DiQuat is bis(trimethylammonium chloride)-2-hydroxypropane.

In order to determine the efficacy of the above treatment, a paper handsheet is prepared from the pulp employed in each Example as well as that of the Control and of the Blank according to the method described in TAPPI Std. No. T205 OS-71. The Control is a handsheet made from pulp bleached in an identical manner except without the quaternary amine for comparison with the Examples of the invention. The Blank is a handsheet made from a sample of the same unbleached pulp.

The brightness test is conducted according to the method in TAPPI Std. No. OS-58. Five measurements are taken on each handsheet and an average brightness determined. The results are shown in the Table. The difference in brightness from that of the blank is indicated therein as Δ Brightness.

TABLE I

| Example Number | Percent# quaternary amine | Brightness (G.E.) | Δ Brightness (G.E.) |
|---|---|---|---|
| Blank | 0 | 44.5 | 0 |
| Control | 0 | 54.3 | 9.8 |
| 1a | 0.5 | 55.9 | 11.4 |

TABLE I-continued

| Example Number | Percent# quaternary amine | Brightness (G.E.) | Δ Brightness (G.E.) |
|---|---|---|---|
| 1b | 1.0 | 55.2 | 10.7 |
| 1c | 2.0 | 50.8 | 6.3 |
| 2a | 0.5 | 55.8 | 11.3 |
| 2b | 1.0 | 54.2 | 9.7 |

#Percent of quaternary amine is based on ODW of the wood pulp.

It is apparent from the above data that small amounts of the quaternary amine produce an improvement in brightness whereas, when the amount equals or exceeds one percent, there is either no positive effect or the effect is negative with respect to the control. The effective amount also appears to depend on the particular quaternary amine being employed.

The procedure is repeated except that after a 1 hour pretreatment, the pulp is deckered (dewatered) the, in a bleaching step, 2.5 weight percent hydrogen peroxide, 2.5 weight percent sodium hydroxide, and 3.0 weight percent (all based on ODW of pulp) sodium silicate are used at 65° C. for 1 hour with the quaternary amines as indicated in Table 2.

TABLE II

| Example Number | Percent# quaternary amine | Brightness (G.E.) | Δ Brightness (G.E.) |
|---|---|---|---|
| unbleached blank | 0 | 47 | — |
| bleached control | 0 | 59.1 | 12.1 |
| 3a | 0.5 | 60.5 | 13.5 |
| 4a | 1.12 | 61.0 | 14.0 |
| 4b | 0.13 | 61.6 | 14.6 |

#Percent of quaternary amine is based on ODW of the wood pulp.
quaternary amine is a 65 weight percent aqueous solution of (3-chloro-2-hydroxypropyl)trimethyl ammonium chloride.
quaternary amine is (2,3-dihydroxypropyl)trimethylammonium chloride diol.

The data in Table 2 show that 0.13 percent (2,3-dihydroxypropyl)trimethyl ammonium chloride is somewhat more effective than 0.5 percent (3-chloro-2-hydroxypropyl) ammonium chloride from which it may be produced by hydrolysis. Concentrations of quaternary amine over one percent are less effective than lower concentrations, but are still more effective than bleaching in the absence of he quaternary amine. Concentrations of up to about 2 weight diol are expected to be useful.

These Examples simulate both a refiner process (Examples 1-2), and a tower process (Examples 3-4) and show effectiveness in both types of process.

We claim:

1. An alkaline composition for bleaching wood pulp comprising water, hydrogen peroxide, at least one stabilizer for the hydrogen peroxide and at least one quaternary amine represented by Formula I or Formula 2 wherein Formula I is:

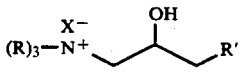

wherein

R is an alkyl group containing 1-3 carbon atoms and R′ is hydrogen, a halogen, hydroxyl, R or $-N^+(R)_3$, together with $X^-$, and $X^-$ is a negatively charged counter-ion;

and Formula 2 is:

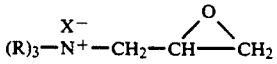

wherein

R is an alkyl group containing 1-3 carbon atoms and $X^-$ is a negatively charged counter-ion wherein the water, stabilizer, and at least one quaternary amine are present in amounts to provide an alkaline composition.

2. The composition of claim 1 wherein the stabilizer is a soluble silicate, aminocarboxylic acid, polyphosphate, polycarboxylic acid, polycarboxylic amide, sulfonic acid derivative of a polycarboxylic amide, aminophosphonic acid or combination thereof.

3. The composition of claim 2 wherein the stabilizer is in the form of an acid or of an alkali metal salt.

4. The composition of claim 2 wherein the stabilizer is an aminophosphonic acid, silicate, aminocarboxylic acid or combination thereof.

5. The composition of claim 4 wherein the stabilizer is an aminophosphonic acid.

6. The composition of claim 5 wherein the aminophosphonic acid is diethylenetriaminepenta(methylenephosphonic acid).

7. The composition of claim 4 wherein the stabilizer is an alkali metal polyphosphate and an alkali metal salt of diethylenetriaminepenta(methylene phosphonic acid).

8. The composition of claim 2 wherein the stabilizer is a silicate.

9. The composition of claim 8 wherein there is additionally present wood pulp, and the quaternary amine is present in an amount of less than about 1 percent by weight based on oven dry weight of the wood pulp.

10. The composition of claim 8 wherein each R in Formula I or formula 2 is methyl.

11. The composition of claim 1 wherein R in Formula I or Formula 2 is an alkyl group containing 1-3 carbon atoms and R′ is a halogen, hydroxyl or $-N^+(R)_3$.

12. The composition of claim 11 wherein each R in Formula I or Formula 2 is a methyl group.

13. The composition of claim 12 wherein quaternary amine is (3-chloro-2-hydroxypropyl)trimethyl ammonium chloride, (2,3-epoxypropyl)trimethyl ammonium chloride, (2,3-dihydroxypropyl)trimethyl ammonium chloride, bis(trimethylammonium chloride)-2-hydroxy propane or a combination thereof.

14. The composition of claim 13 wherein the quaternary amine is (3-chloro-2-hydroxypropyl)trimethyl ammonium chloride.

15. The composition of claim 13 wherein the quaternary amine is (2,3-epoxypropyl)trimethyl ammonium chloride.

16. The composition of claim 13 wherein the quaternary amine is (2,3-dihydroxypropyl)trimethyl ammonium chloride.

17. The composition of claim 13 wherein the quaternary amine is bis(trimethylammonium chloride)-2-hydroxy propane.

18. The composition of claim 1 additionally comprising wood pulp.

19. The composition of claim 18 wherein the quaternary amine is present in an amount of less than about 1 percent by weight based on oven dry weight of the wood pulp.

20. The composition of claim 18 wherein quaternary amine is (3-chloro-2-hydroxypropyl)trimethyl ammonium chloride, (2,3-epoxypropyl)trimethyl ammonium chloride, (2,3-dihydroxypropyl)trimethyl ammonium chloride, bis(trimethylammonium chloride)-2-hydroxy propane or a combination thereof.

21. The composition of claim 20 wherein the quaternary amine is (3-chloro-2-hydroxypropyl)trimethyl ammonium chloride.

22. The composition of claim 20 wherein the quaternary amine is (2,3-dihydroxypropyl)trimethyl ammonium chloride.

23. The composition of claim 20 wherein the quaternary amine is bis(trimethylammonium chloride)-2- hydroxypropane.

24. The composition of claim 20 wherein the quaternary amine is (2,3-epoxypropyl) trimethyl ammonium chloride.

25. The composition of claim 18 wherein the stabilizer comprises an aminophosphonic acid, a silicate, an aminocarboxylic acid or combination thereof.

* * * * *